US008739372B2

(12) United States Patent
Hasegawa et al.

(10) Patent No.: US 8,739,372 B2
(45) Date of Patent: Jun. 3, 2014

(54) FASTENER STRINGER FOR HIDDEN SLIDE FASTENER

(75) Inventors: Takayuki Hasegawa, Toyama (JP); Akira Takano, Toyama (JP); Masashi Doi, Toyama (JP)

(73) Assignee: YKK Corporation (JP)

( * ) Notice: Subject to any disclaimer, the term of this patent is extended or adjusted under 35 U.S.C. 154(b) by 86 days.

(21) Appl. No.: 13/393,247

(22) PCT Filed: Sep. 4, 2009

(86) PCT No.: PCT/JP2009/065497

§ 371 (c)(1),
(2), (4) Date: Feb. 29, 2012

(87) PCT Pub. No.: WO2011/027458

PCT Pub. Date: Mar. 10, 2011

(65) Prior Publication Data

US 2012/0151718 A1 Jun. 21, 2012

(51) Int. Cl.

*D03D 1/00* (2006.01)
*A44B 19/34* (2006.01)
*A44B 19/08* (2006.01)

(52) U.S. Cl.

CPC ..... *A44B 19/346* (2013.01); *D03D 1/00* (2013.01); *D10B 2501/0631* (2013.01); *A44B 19/08* (2013.01)

USPC ..... 24/393; 24/392; 24/397; 24/398; 24/426

(58) Field of Classification Search

CPC ..... A44B 19/12; A44B 19/34; A44B 19/334; A44B 19/336; A44B 19/40; A44B 19/52; A44B 19/54

USPC ..... 24/392, 393, 397, 398, 426

See application file for complete search history.

(56) References Cited

U.S. PATENT DOCUMENTS 3,430,304 A * 3/1969 Swainson ..... 24/394
3,789,465 A * 2/1974 Moertel ..... 24/395

(Continued)

FOREIGN PATENT DOCUMENTS

JP 48-36001 Y1 10/1973
JP 49-9447 Y1 3/1974

(Continued)

OTHER PUBLICATIONS

International Search Report, PCT International Application No. PCT/JP2009/065497, mailed Dec. 1, 2009.

*Primary Examiner* — Robert J Sandy
*Assistant Examiner* — David Upchurch
(74) *Attorney, Agent, or Firm* — Kilpatrick Townsend & Stockton LLP

(57) ABSTRACT

The invention provides a fastener stringer for a hidden slide fastener. Each of the fastener tapes includes a main tape body, a folded tape portion which is folded into a U-shape, and an element attaching portion. The folded tape portion includes at least two multiple-weave portions in which warp yarn forms a multiple-weave structure, and a single-weave portion arranged at least at one location of an intermediate portion of the folded tape portion. According to this, it is possible to enhance rigidity of the folded tape portion in a lateral direction of a tape, and to prevent a position of the warp yarn from being misaligned at the multiple-weave portion. Therefore, hiding performance of the hidden slide fastener can be enhanced.

26 Claims, 6 Drawing Sheets

(56) References Cited

U.S. PATENT DOCUMENTS

| | | | | | |
|---|---|---|---|---|---|
| 3,795,950 | A | * | 3/1974 | Sohr | 24/395 |
| 3,855,672 | A | * | 12/1974 | Takamatsu | 24/394 |
| 3,900,928 | A | * | 8/1975 | Takamatsu | 24/393 |
| 3,919,744 | A | * | 11/1975 | Kandou | 24/393 |
| 3,922,760 | A | * | 12/1975 | Matsuda | 24/393 |
| 3,952,380 | A | * | 4/1976 | Takamatsu | 24/393 |
| 3,974,550 | A | | 8/1976 | Fujisaki et al. | |
| 4,058,145 | A | | 11/1977 | Fruhlich et al. | |
| 4,125,911 | A | * | 11/1978 | Moertel | 5/652.1 |
| 4,143,680 | A | * | 3/1979 | Murai et al. | 139/384 B |
| 4,566,156 | A | * | 1/1986 | Sarasue et al. | 24/398 |
| 5,699,592 | A | * | 12/1997 | Shimono | 24/432 |
| 7,293,434 | B2 | * | 11/2007 | Ikeguchi et al. | 66/193 |

FOREIGN PATENT DOCUMENTS

| | | |
|---|---|---|
| JP | 49-116205 | 4/1976 |
| JP | 5263376 | 12/1978 |
| JP | 5263377 | 12/1978 |

* cited by examiner

FASTENER STRINGER FOR HIDDEN SLIDE FASTENER

This application is a national stage application of PCT/JP2009/065497, which is incorporated herein by reference.

TECHNICAL FIELD

The invention relates to a fastener stringer for a hidden slide fastener having an excellent hiding performance in which when left and right element rows are coupled to each other, the coupled element rows are hidden so that the element rows can not be seen from an outer surface of the fastener stringer which is exposed outside of the stringer.

BACKGROUND ART

Generally, slide fasteners are broadly divided into two typical types, i.e., a normal type slide fastener in which left and right coupled element rows are arranged on a surface side of a fastener tape and are exposed, and a hidden type slide fastener (so-called hidden slide fastener) which can be hidden such that left and right coupled element rows can not be seen from outside. The hidden slide fastener is preferably used for products such as various clothes and shoes, taking advantage of a merit that design of a product is not lowered due to its hiding performance and in recent years, the hidden slide fasteners have been also used for seat covers for seats for automobiles and trains or the like.

Japanese Utility Model Application Publication No. 49-9447 (Patent Document 1) discloses an example of the fastener stringer used for such a hidden slide fastener. The fastener stringer for the hidden slide fastener described in Patent Document 1 includes a pair of left and right woven fastener tapes, and a continuous coil fastener element or a zigzag fastener element which is sewed to left and right fastener tapes using sewing yarn.

Each of the left and right fastener tapes includes a main tape body, a folded tape portion which extends in its lateral direction from one side edge of the main tape body and which is folded into a U-shape, and an element attaching portion which extends from the folded tape portion and to which a fastener element is sewed. The fastener element is sewed to the element attaching portion of the fastener tape in a state where a coupling head of the fastener element projects outward from the folded tape portion.

According to the fastener stringer described in Patent Document 1, synthetic fiber is used as warp yarn and weft yarn which are arranged in an end edge portion of the main tape body on the side of the folded tape portion, the folded tape portion and the element attaching portion (these regions are called reversed portions, hereinafter). If thermoplasticity of the synthetic fiber used for these yarn is utilized, it is possible to maintain the fastener tape in a predetermined shape.

According to the fastener stringer of Patent Document 1, since it is possible to maintain the fastener tape in a predetermined shape, a fastener element attached to an element attaching portion of the fastener tape can smoothly be introduced into a slider body in a normal posture. Therefore, sliding resistance of the slider becomes small, and the slide fastener can be opened and closed very easily.

In Patent Document 1, warp yarn made of synthetic fiber is arranged over the entire region of the reversed portions, but according to circumstances, it is described that it is also possible to locally arrange warp yarn made of synthetic fiber in the folded tape portion, or to alternately arrange warp yarn made of synthetic fiber and other warp yarn (e.g., warp yarn made of natural fiber) in the reversed portion, or to arrange warp yarn made of synthetic fiber and other warp yarn doubly in the reversed portion.

CITATION LIST

Patent Document

Patent Document 1: Japanese Examined Utility Model Application Publication No. 49-9447

SUMMARY OF THE INVENTION

Problems to be Solved by the Invention

The fastener stringer for a hidden slide fastener described in Patent Document 1, as described above, can maintain the fastener tape in a predetermined shape by arranging warp yarn made of synthetic fiber in the reversed portion of the fastener tape.

In the fastener stringer of Patent Document 1, however, when a lateral tensile force (laterally pulling force) is applied to the fastener tape in a state where left and right fastener elements are coupled to each other, for example, folded tape portions which are intimately close to each other are separated from each other in the left and right fastener tapes, and a gap is formed between the left and right fastener tapes. Hence, the coupled fastener elements can be seen from the outer surface side of the fastener stringer through the gap formed between the fastener tapes, and hiding performance of the hidden slide fastener formed of the fastener stringer is low.

Therefore, if such a hidden slide fastener is attached to a product such as a seat cover for an automobile, for example, the fastener element can easily be seen from between the left and right fastener tapes. Therefore, there is a possibility that outward appearance of the product is deteriorated or the design of the produce is deteriorated.

On the other hand, as described above, as a modification of Patent Document 1, a fastener stringer in which warp yarn made of synthetic fiber and other warp yarn are doubly arranged in the reversed portion is described. Since the reversed portion is formed by the double-weave structure of warp yarn, rigidity of the reversed portion is increased in some cases.

According to this, even if the left and right fastener tapes receive a lateral tensile force, the folded tape portions do not easily move in their separating directions. Hence, a gap formed between the left and right fastener tapes can be made small, or it is possible to prevent a gap from being formed between the left and right fastener tapes, and to enhance the hiding performance of the hidden slide fastener.

In the case of the modification of Patent Document 1, however, since warp yarn is arranged merely in a side-by-side relation in the double-weave structure in the reversed portion of the fastener tape, a position of warp yarn arranged on a side of the tape inner surface and a position of warp yarn arranged on a side of the tape outer surface are easily misaligned. If the positions of warp yarn are misaligned between the tape inner surface side and the tape outer surface side, the rigidity of the reversed portion can not effectively be increased, and the hiding performance can not be enhanced.

According to the modification of Patent Document 1, an element attaching portion of the fastener tape is made thick in a double-weave structure. Hence, when the fastener element is sewed to the element attaching portion using sewing yarn, for example, a sewing-machine needle can not easily be inserted into the element attaching portion and the sewing-machine needle may be broken.

The invention has been accomplished in view of the conventional problem, and a concrete object of the invention is to provide a fastener stringer for a hidden slide fastener capable of preventing a gap from being formed between left and right fastener tapes, or capable of making formed gaps small and stably hiding the fastener elements even if the left and right fastener tapes receive a lateral tensile force when fastener elements are coupled to each other.

Means for Solving the Problems

To achieve the above object, the invention provides a fastener stringer for a hidden slide fastener including a pair of left and right woven fastener tapes, and continuous fastener elements attached to the left and right fastener tapes, in which each of the left and right fastener tapes includes a main tape body, a folded tape portion which extends from one side edge of the main tape body in a lateral direction of a tape and which is folded into a U-shape, and an element attaching portion which further extends from the folded tape portion and to which the fastener element is attached, the fastener element includes a coupling head, upper and lower legs extending from the coupling head, and a connecting portion which connects between the fastener elements which are adjacent to each other, being most essentially characterized in that the folded tape portion includes at least two multiple-weave portions in which warp yarn forms a multiple-weave structure, and a single-weave portion which is arranged at at least one location of an intermediate portion of the folded tape portion and in which warp yarn forms a single-weave structure.

To achieve the above object, the invention provides a fastener stringer for a hidden slide fastener including a pair of left and right woven fastener tapes, and continuous fastener elements attached to the left and right fastener tapes, in which each of the left and right fastener tapes includes a main tape body, a folded tape portion which extends from one side edge of the main tape body in a lateral direction of a tape and which is folded into a U-shape, and an element attaching portion which further extends from the folded tape portion and to which the fastener element is attached, the fastener element includes a coupling head, upper and lower legs extending from the coupling head, and a connecting portion which connects between the fastener elements which are adjacent to each other, being most essentially characterized in that the folded tape portion includes at least two multiple-weave portions in which two or more layers of weave portions formed of warp yarn are laminated on each other, and a binding portion which closes at least the two layers of weave portions of the multiple-weave portions at at least one location between the two multiple-weave portions.

In the fastener stringer for a hidden slide fastener of the invention as described above, it is preferable that the single-weave portion or the binding portion be arranged on at least one end of the folded tape portion.

In the fastener stringer for a hidden slide fastener of the invention, it is preferable that a first warp yarn be used as warp yarn which is arranged in the main tape body, and a second warp yarn which is thicker than the first warp yarn be used as at least a portion of warp yarn arranged in the folded tape portion.

In this case, it is especially preferable that the first warp yarn be used as the warp yarn which is arranged in the folded tape portion and which is exposed outside when the left and right fastener elements are coupled to each other.

It is preferable that the element attaching portion include the multiple-weave portions at an end edge of the folded tape portion.

In this case, it is preferable that the fastener element be sewed using sewing yarn, and the first warp yarn be used as at least one of warp yarn arranged in the multiple-weave portions of the element attaching portion. Especially, it is further preferable that of warp yarn arranged in the multiple-weave portions of the element attaching portion, the first warp yarn be used as warp yarn for a portion through which the sewing yarn thrusts, and the second warp yarn be used as warp yarn of other portions.

In the invention, it is preferable that yarn of 150 dtex (decitex) or more and 450 dtex or less, 4.5 dtex (decitex)/f (filament) or more and 10.0 dtex/f or less be used as the first warp yarn, and yarn of 500 dtex or more and 2,000 dtex or less, 1.0 dtex/f or more and 4.0 dtex/f or less be used as the second warp yarn.

Further, in the invention, it is preferable that the multiple-weave portions be composed of a double-weave portion of a 1/3, 3/1 structure, and the single-weave portion arranged in the intermediate portion of the folded tape portion be formed of a 1/1 structure.

In the invention, it is preferable that a region of the element attaching portion from the warp yarn arranged in the end edge of the tape to the warp yarn which is adjacent to the multiple-weave portions be formed of a single-weave structure, and the warp yarn which is adjacent to the multiple-weave portions has a 1/1 structure.

It is preferable that the fastener element be sewed to the fastener tapes by double chain stitching of the sewing yarn, and yarn of 840 dtex or more and 990 dtex or less be used as the upper yarn of the sewing yarn which thrusts through the fastener tapes, and yarn of 234 dtex or more and 705 dtex or less be used as the lower yarn which passes through the fastener element on a side of the lower leg.

Effects of the Invention

According to the fastener stringer for a hidden slide fastener of the invention, each of the fastener tapes includes the main tape body, the folded tape portion which is folded into the U-shape, and the element attaching portion to which the fastener element is attached. The folded tape portion includes at least the two multiple-weave portions in which the warp yarn forms the multiple-weave structure, and the single-weave portion in which the warp yarn forms the single-weave structure. The single-weave portion is arranged at at least one location in the intermediate portion of the folded tape portion.

According to such a fastener stringer of the invention, since the folded tape portion has the multiple-weave portion, it is possible to enhance the rigidity of the folded tape portion in the lateral direction of the tape. Since at least one location of the intermediate portion of the folded tape portion has the single-weave portion, it is possible to prevent a position of the warp yarn from being misaligned in the lateral direction of the tape in the multiple-weave portion.

According to this, even if the left and right fastener tapes receive the lateral tensile force, it is possible to make it difficult to move the folded tape portions in their separating directions. Hence, it is possible to prevent a gap from being formed between the left and right fastener tapes, or to reduce, in size, a gap formed between the left and right fastener tapes and to reliably enhance the hiding performance of the hidden slide fastener.

According to the fastener stringer of the invention, the rigidity of the folded tape portion is enhanced, and at least one location of the intermediate portion of the folded tape portion has the single-weave portion. Hence, it is possible to secure bending of the folded tape portion at the single-weave portion, and to stably fold the fastener tape into the U-shape. Therefore, it is possible to avoid a case where a posture of the fastener element attached to the element attaching portion is inclined with respect to the slider.

According to the invention, the fastener stringer for a hidden slide fastener having the folded tape portion including at least two multiple-weave portions in which two or more weave portions formed by warp yarn are laminated on each other, and a binding portion which closes at least the two layers of weave portions of the multiple-weave portions in at least one location between the two multiple-weave portions is provided.

Even with the fastener stringer of the invention, since the folded tape portion includes at least two multiple-weave portions, it is possible to enhance the rigidity of the folded tape portion in the lateral direction of the tape. Further, since the binding portion is provided at at least one location between at least the two folded tape portions, it is possible to prevent the position of the warp yarn in the multiple-weave portion from being misaligned in the lateral direction of the tape. Therefore, even if the left and right fastener tapes receive a tensile force in the lateral direction, it is possible to make it difficult to move the folded tape portions in their separating directions, and it is possible to reliably enhance the hiding performance of the hidden slide fastener.

Here, the binding portion is a structure which binds, to each other, and closes (connects) two or more layers of weave portions superpose in a front/back direction of the tape. The binding portion is one warp yarn which is arranged between the multiple-weave portions and which alternately runs on an upper side and a lower side of the weft yarn in accordance with a predetermined rule, or the binding portion can be composed of two or more warp yarn which are arranged between the multiple-weave portions in parallel to the lateral direction of the tape and which alternately run on the upper side and the lower side of the weft yarn in accordance with a predetermined rule. Alternatively, the binding portion can be composed of weft yarn which is horizontally arranged astride one weave portion and the other weave portion which are superposed and arranged in the front/back direction of the tape.

In the fastener stringer of the invention, at least one end of the folded tape portion can include a single-weave portion or a binding portion. According to this, bending of the folded tape portion can be secured in at least one end of the folded tape portion, and it is possible to more stably fold the fastener tape into the U-shape. In this case, the single-weave portion or the binding portion which secures the bending can be provided on an end of the folded tape portion on the side of the main tape body, on an end of the folded tape portion on the side of the element attaching portion, or on both side ends of the folded tape portion.

According to the fastener stringer of the invention, the second warp yarn which is thicker than the first warp yarn arranged in the main tape body can be used as at least a portion of warp yarn arranged in the folded tape portion of the fastener tape. According to this, it is possible to further enhance the rigidity of the folded tape portion in the lateral direction of the tape, and to further enhance the hiding performance of the hidden slide fastener.

In this case, the first warp yarn can be used as the warp yarn which is arranged in the folded tape portion and which is exposed outside when the left and right fastener elements are coupled to each other. In other words, warp yarn having the same thickness as that of the main tape body is used as warp yarn which is arranged, in the folded tape portion, on the side of the tape outer surface, and which is arranged in a region of the folded tape portion closer to the main tape body side than a portion that is in intimate contact with the left and right folded tape portions. According to this, asperities caused by differences in thickness of the warp yarn are not formed on the tape outer surface from the main tape body to the intimate contacted portion of the folded tape portion, and the tape outer surface can be formed flatly. Hence, the outward appearance of the fastener stringer can be enhanced.

The element attaching portion of the fastener stringer of the invention can include the multiple-weave portion in which warp yarn forms the multiple-weave structure on an end edge end portion of the side of the folded tape portion. According to this, rigidity of a boundary portion between the element attaching portion and the folded tape portion can be enhanced, and the hiding performance of the fastener stringer can further be enhanced. According to the invention, not only the end edge of the element attaching portion on the side of the folded tape portion, but also the entire element attaching portion can be composed of the multiple-weave portion.

In this case, the fastener element can be sewed to the element attaching portion using sewing yarn, and the first warp yarn can be used as at least one of warp yarn arranged in the multiple-weave portions of the element attaching portion. Especially, of warp yarn arranged in the multiple-weave portions of the element attaching portion, the first warp yarn can be used as warp yarn for a portion through which sewing yarn sewing the fastener element thrusts, and the thicker second warp yarn is used as warp yarn for other portions. Accordingly, the sewing needle can easily thrust through the fastener tape when the fastener element is sewed while enhancing the rigidity of the boundary portion between the element attaching portion and the folded tape portion, and it is possible to prevent the sewing needle from breaking.

In the fastener stringer of the invention, yarn of 150 dtex or more and 450 dtex or less, 4.5 dtex/f or more and 10.0 dtex/f or less can be used as the first warp yarn. Accordingly, it is possible to enhance the rigidity of the main tape body in the longitudinal direction of the tape.

When the fastener tape of the fastener stringer is sewed to an automobile seat cover as a product, for example, the seat cover is formed relatively thick. Hence, if the main tape body of the fastener tape is formed soft, the fastener tape gets beaten by a tensile force of sewing yarn and corrugated crinkles are generated in the fastener tape when the fastener tape is sewed to the seat cover, and there could be a problem that such as shrinkage of a sewed product is generated. On the other hand, if the rigidity of the main tape body in the longitudinal direction of the tape is enhanced, even when the fastener tape is sewed to a thick product, it is possible to avoid the problem such as the shrinkage of the sewed product.

In the fastener stringer of the invention, yarn of 500 dtex or more and 2,000 dtex or less, 1.0 dtex/f or more and 4.0 dtex/f or less can be used as the second warp yarn which is arranged in the folded tape portion or the like. Accordingly, the folded tape portion in which the second warp yarn is arranged can easily be provided with rigidity, and the thickness of the tape such as the folded tape portion can be increased. Hence, the hiding performance of the fastener element can more stably be secured.

In the fastener stringer of the invention, the multiple-weave portions can be composed of a double-weave portion of a 1/3, 3/1 structure. Accordingly, weave textures do not become coarse, and the multiple-weave portion can stably be formed.

The single-weave portion arranged in the intermediate portion of the folded tape portion can be formed of a 1/1 structure. Accordingly, it is possible to stabilize woven structures of the multiple-weave portions arranged on both sides of the single-weave portion.

Further, in the fastener stringer of the invention, a region of the element attaching portion from the warp yarn arranged in the end edge of the tape to the warp yarn which is adjacent to the multiple-weave portions is formed of a single-weave structure, and the warp yarn which is adjacent to the multiple-weave portions can have a 1/1 structure. Accordingly, it is possible to firmly form the element attaching portion without generating the misalignment of the weave texture. Hence, it is possible to stably sew the fastener element to the element attaching portion.

In the fastener stringer of the invention, the fastener element is sewed to the fastener tape by double chain stitching, yarn of 840 dtex or more and 990 dtex or less is used as the upper yarn of the sewing yarn, and yarn of 234 dtex or more and 705 dtex or less is used as the lower yarn.

The fastener element is sewed to the element attaching portion using the sewing yarn having the upper yarn and the lower yarn described above. Accordingly, it is possible to sew the fastener element to the element attaching portion while strongly fastening the fastener element by the upper yarn without cutting the yarn. The lower yarn which is exposed to the lower leg of the fastener element is made thinner than the upper yarn. Accordingly, it is possible to make the lower yarn less noticeable, and to enhance the outward appearance of the fastener stringer.

BEST MODE FOR CARRYING OUT THE INVENTION

An embodiment of the invention will be described in detail with reference to the drawings. It should be noted that the invention is not limited to the embodiment which will be described below, and the invention can variously be modified only if the modification has substantially the same configuration and exerts the same effect as those of the invention.

In the following embodiment, for example, although a case where a continuous coil-like fastener element is sewed to an element attaching portion of a fastener tape will be described, the invention is not limited to this, and it is possible to sew a zigzag continuous fastener element to the element attaching portion instead of the coil-like fastener element.

Figure 1:
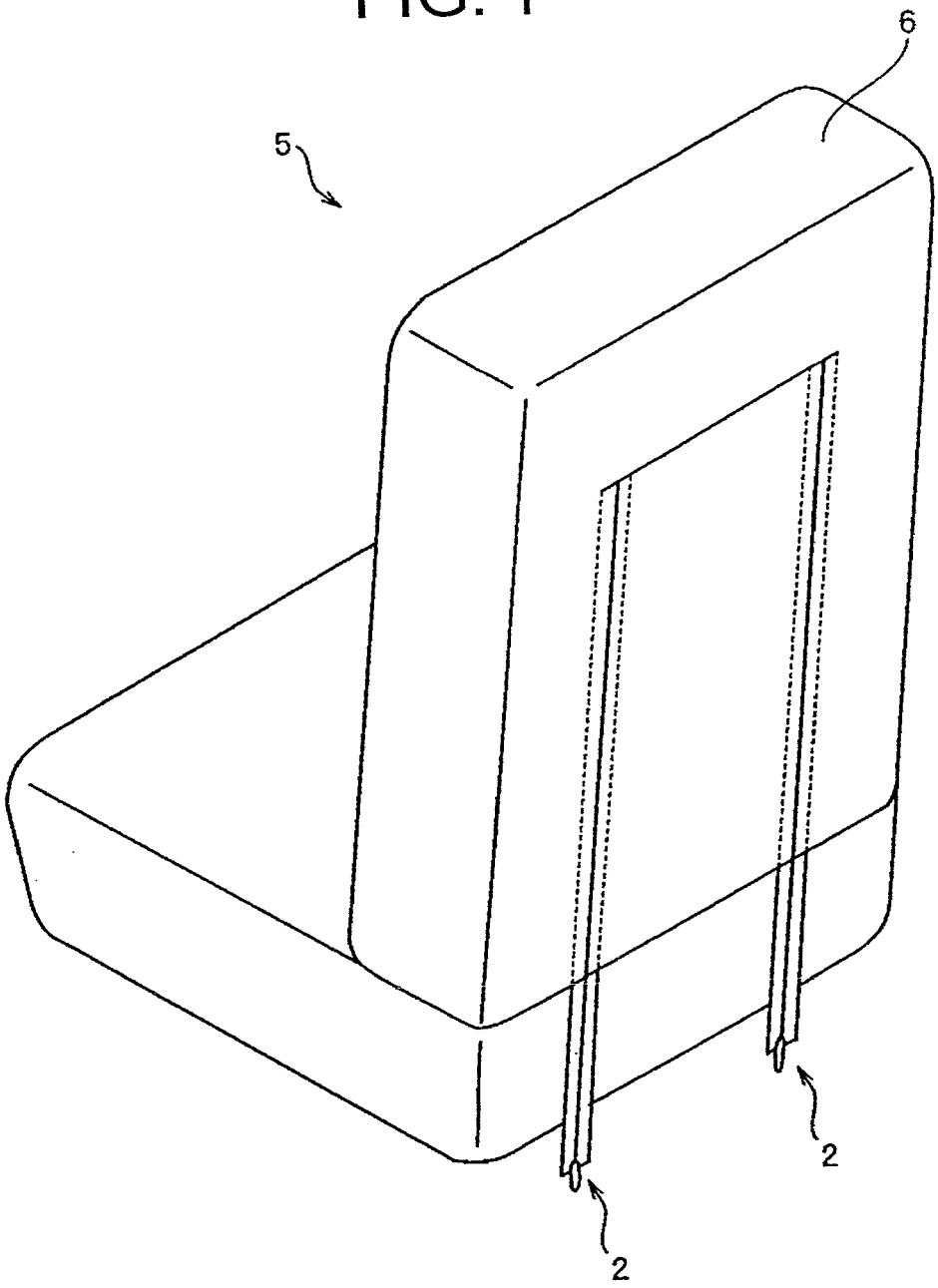
FIG. 1 is a perspective view of a seat for an automobile in which a fastener stringer for a hidden slide fastener of the invention is used.
Figure 2:
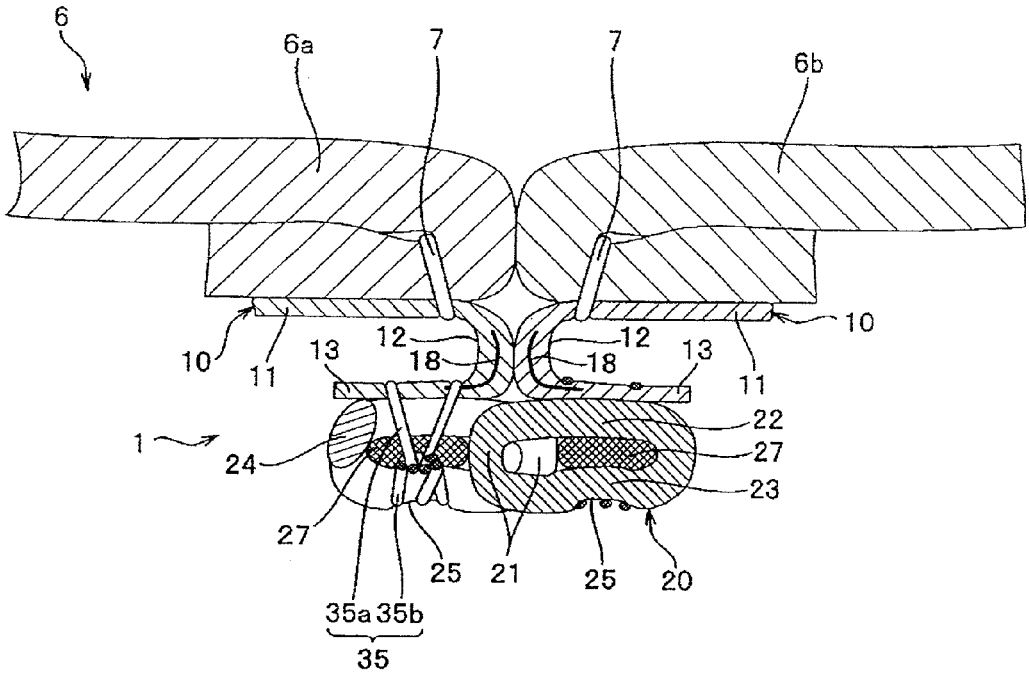
FIG. 2 is a schematic sectional view showing a state where the fastener stringer is sewed to a skin material for a seat of an automobile.
Figure 3:
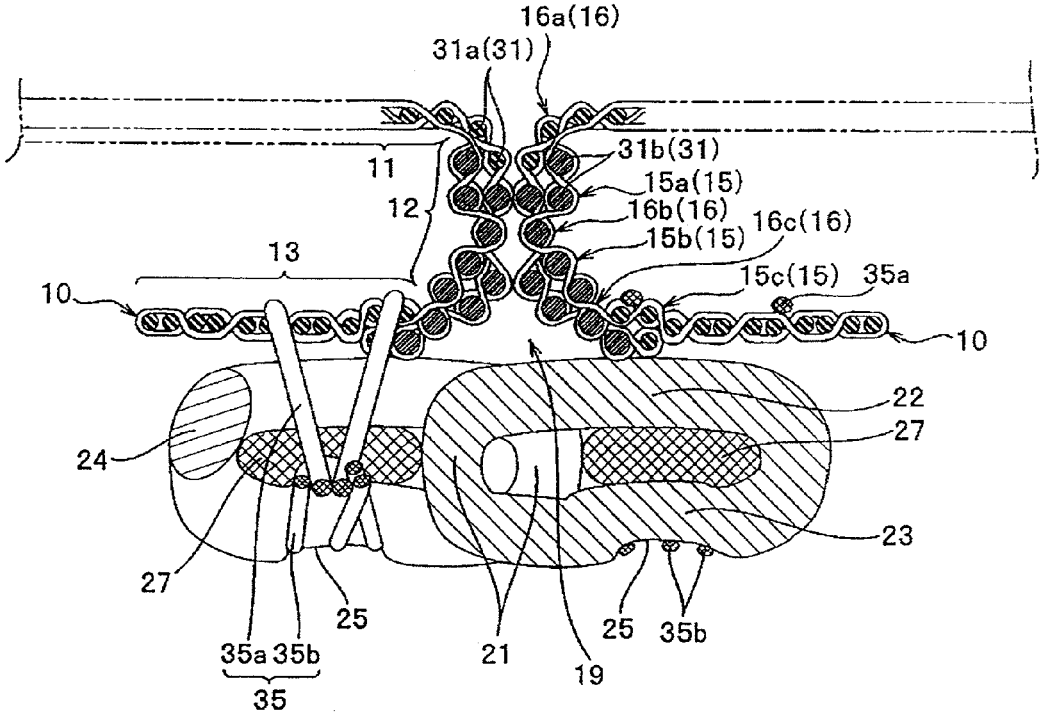
FIG. 3 is a sectional view of the fastener stringer schematically showing a portion of a woven structure of a fastener tape.

FIG. 1 is a perspective view of a seat for an automobile in which a fastener stringer for a hidden slide fastener of the invention is used. FIG. 2 is a schematic sectional view showing a state where the fastener stringer is sewed to a skin material for a seat of an automobile. FIG. 3 is a sectional view of the fastener stringer schematically showing a portion of a woven structure of a fastener tape.

In the drawings which are referred to in the description of the embodiment, various warp yarn and weft yarn are shown relatively thick to make it easier to understand the feature of the invention, and a woven structure of a fastener tape is also shown coarsely. In an actual fastener stringer, however, predetermined yarn having preset thickness and the like is used as various warp yarn and weft yarn configuring a fastener tape, and the woven structure of the fastener tape is configured densely.

According to a fastener stringer 1 for hidden slide fasteners of the embodiment, sliders (not shown) are slidably attached along fastener elements 20, thereby configuring the hidden slide fasteners 2. The hidden slide fasteners 2 which are configured in this manner are attached to the back surface side of a seat cover 6 of an automobile seat 5 shown in FIG. 1, for example, and is used.

In this case, as shown in FIG. 2, the hidden slide fasteners 2 are attached to the seat cover 6 by sewing later-described main tape bodies 11 of fastener tapes 10 in the fastener stringer 1 to a skin material 6*a* of the seat cover 6.

According to the automobile seat 5 shown in FIG. 1, portions of the hidden slide fasteners 2 project from lower end edges of the seat cover 6 which covers a backrest of the automobile seat 5. After the hidden slide fasteners 2 are closed, the projecting portions of the hidden slide fasteners 2 are pushed in between the a cushion and a seat cover 6 of the automobile seat 5 and are held such that they can not be seen from outside.

In FIG. 2, to make it easier to understand regions (double-weave regions) 18 where later-described double-weave portions 15 of the fastener tape 10 are formed, the double-weave regions 18 are schematically shown. Not only the double-weave portions 15 but also single-weave portions 16 are formed in the double-weave regions 18 as will be described later.

As shown in FIG. 3, the fastener stringer 1 of the embodiment which is applied to the seat cover 6 for an automobile and the like includes the pair of left and right woven fastener tapes 10, and coil-like fastener elements 20 which are respectively sewed to the left and right fastener tapes 10.

Each of the left and right fastener tapes 10 includes a main tape body 11 sewed to the skin material 6*a* of the seat cover 6, a folded tape portion 12 which extends from one side edge of the main tape body 11 in a lateral direction of the tape and which is folded into a U-shape, and an element attaching portion 13 which further extends from the folded tape portion 12. A tape surface of the fastener tape 10 to which the fastener element 20 is attached is called an outer surface, and a tape surface which is opposite to the outer surface is called an inner surface.

Figure 4:
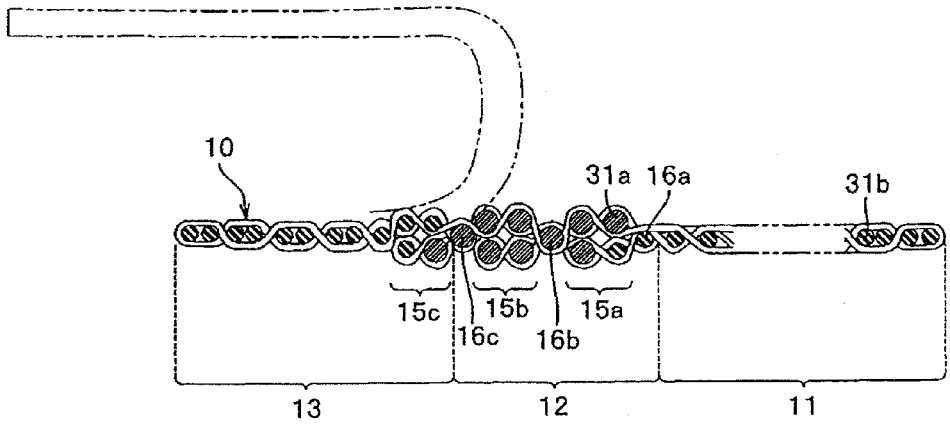
FIG. 4 is a sectional view of the fastener tape schematically showing the portion of the woven structure.
Figure 5:
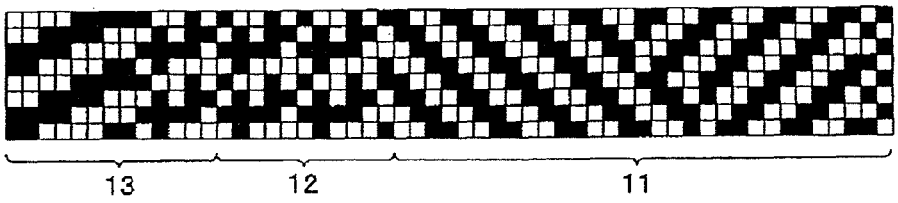
FIG. 5 is a diagram of the woven structure of the fastener tape.
Figure 6:
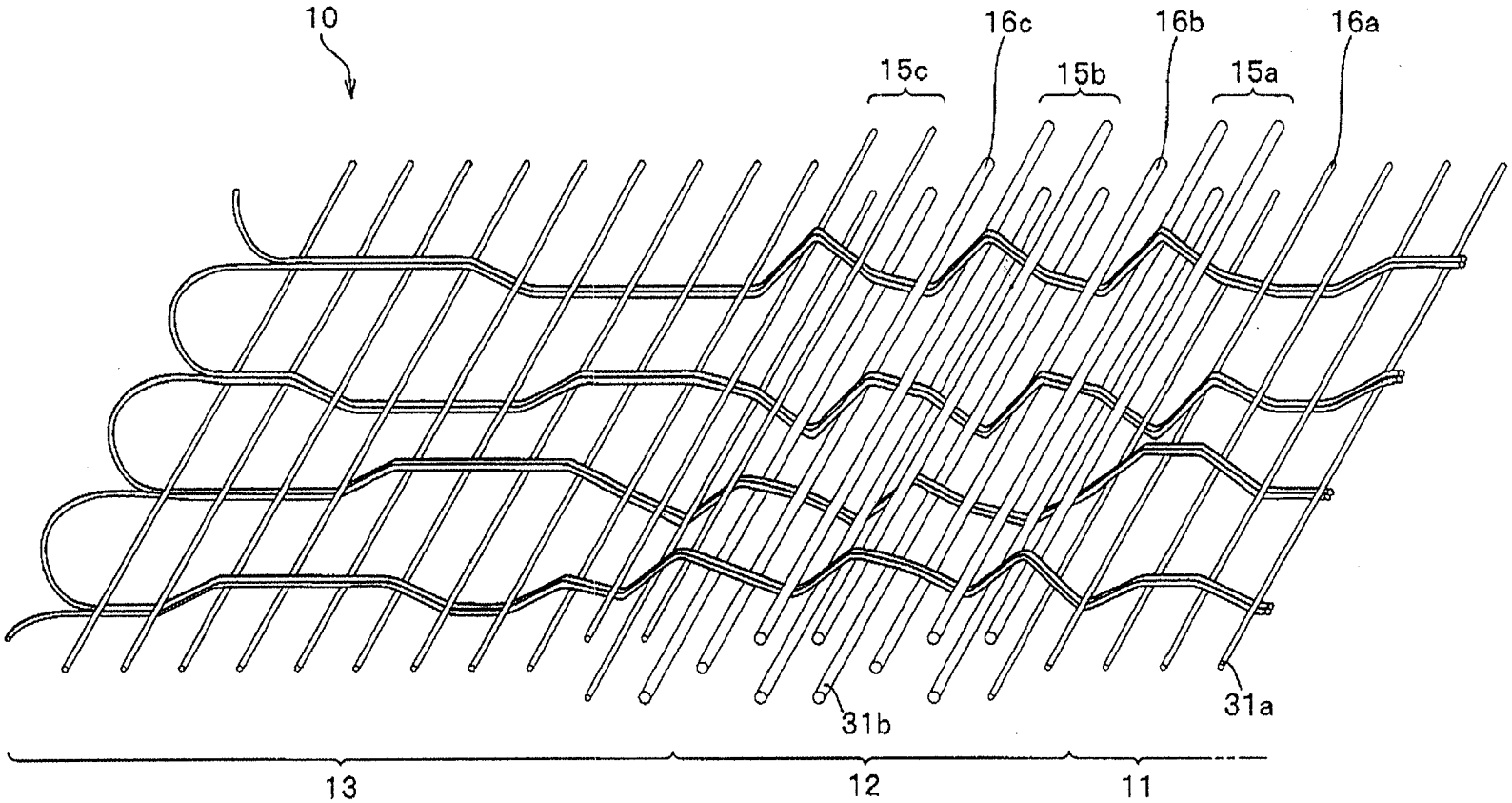
FIG. 6 is a perspective view schematically showing the woven structure of the fastener tape.

As shown in FIGS. 4 to 6, the woven structure of the fastener tape 10 is formed by reciprocating a carrier bar in an opening of warp yarn 31, and laterally weaving foundation weft yarn 32. The woven structure of each portion of the fastener tape 10 will be described specifically.

The main tape body 11 is woven by the foundation weft yarn 32 and first warp yarn 31*a*. The foundation weft yarn 32 includes one set of two justified single-yarn. The woven structure is composed of a 2/2 structure in which the first warp yarn 31*a* alternately runs on an upper side of two sets of foundation weft yarn 32 and a lower side of two sets of foundation weft yarn 32.

In this case, each of the single-yarn arranged as the foundation weft yarn 32 is polyester fiber of 350 dtex or more and 650 dtex or less, 4.5 dtex/f or more and 10.0 dtex/f or less and more preferably, polyester fiber of 450 dtex or more and 550 dtex or less, 6.0 dtex/f or more and 8.0 dtex/f or less.

The first warp yarn 31*a* is polyester fiber of 150 dtex or more and 450 dtex or less, 4.5 dtex/f or more and 10.0 dtex/f or less and more preferably, polyester fiber of 200 dtex or more and 350 dtex or less, 6.0 dtex/f or more and 8.0 dtex/f or less.

Yarn having such thickness is called low count yarn, since the first warp yarn 31*a* is made of low count yarn, it is possible to enhance the rigidity of the main tape body 11 in the longitudinal direction of the tape. In the invention, materials of the weft yarn 32, the first warp yarn 31*a* and later-described second warp yarn 31*b* are not especially limited and it is possible to freely select synthetic fiber and natural fiber other than the polyester fiber and used for the yarn.

If the rigidity of the main tape body 11 is enhanced using the first warp yarn 31*a*, even if the skin material 6*a* of the seat cover 6 for an automobile is formed thick (see FIG. 2), a case where the fastener tape 10 gets beaten by a tensile force of sewing yarn 7 and corrugated crinkles are generated when the main tape body 11 of the fastener tape 10 is sewed to the thick skin material 6*a* by the sewing yarn 7 does not occur, and it is possible to prevent problems such as shrinkage of a sewed product from being generated.

The folded tape portion 12 of the fastener tape 10 includes a double-weave portion 15 in which the warp yarn 31 forms a double-weave structure and a single-weave portion 16 in which the warp yarn 31 forms a single-weave structure. In this case, the folded tape portion 12 includes two double-weave portions 15, i.e., a first double-weave portion 15*a* arranged on the side of the main tape body 11 and a double-weave portion 15*b* arranged on the side of the element attaching portion 13.

These first and second double-weave portions 15*a* and 15*b* are composed of 1/3, 3/1 structures in which the upper warp yarn 31 runs on a lower side of one set of foundation weft yarn 32 and an upper side of three sets of foundation weft yarn 32, and the lower warp yarn 31 runs on the lower side of three sets of foundation weft yarn 32 and upper side of one set of foundation weft yarn 32.

By forming the first and second double-weave portions 15*a* and 15*b* on the folded tape portion 12, it is possible to enhance the rigidity of the folded tape portion 12 and to prevent the folded tape portion 12 from being bent more than a predetermined curvature.

In the invention, the first and second double-weave portions 15*a* and 15*b* can be composed of 1/4, 4/1 structures but if the double-weave portions 15*a* and 15*b* are composed of 1/4, 4/1 structures, weave textures of the double-weave portions 15*a* and 15*b* become coarse. Hence, it is preferable that the double-weave portions 15*a* and 15*b* be composed of 1/3, 3/1 structures as described above.

Single-weave portions 16*a*, 16*b* and 16*c* are respectively formed between the main tape body 11 and the first double-weave portion 15*a* of the folded tape portion 12, between the first double-weave portion 15*a* and the second double-weave portion 15*b*, and between the second double-weave portion 15*b* and the element attaching portion 13.

The single-weave portions 16*a*, 16*b* and 16*c* configure binding portions which bind, to each other, and close a weave portion on the side of the tape inner surface and a weave portion on the side of the tape outer surface which are superposed on the first and second double-weave portions 15*a* and 15*b*. By forming the single-weave portions (binding portions) 16*a*, 16*b* and 16*c*, it is possible to prevent a position of the warp yarn 31 from being misaligned in the lateral direction in the first and second double-weave portions 15*a* and 15*b*, and appropriate bending of the folded tape portion 12 can be secured and the fastener tape 10 can stably be folded into the U-shape even if the rigidity of the folded tape portion 12 is increased as described above.

In this case, the single-weave portion (binding portion) 16*a* formed between the main tape body 11 and the first double-weave portion 15*a* is composed of a 2/2 structure in which one warp yarn 31 alternately runs on an upper side of two sets of foundation weft yarn 32 and a lower side of two sets of foundation weft yarn 32. On the other hand, each of the single-weave portions (binding portions) 16*b* and 16*c* respectively formed between the first double-weave portion 15*a* and the second double-weave portion 15*b*, and between the second double-weave portion 15*b* and the element attaching portion 13 is composed of a 1/1 structure in which one warp yarn 31 alternately runs on an upper side of one set of foundation weft yarn 32 and a lower side of one set of foundation weft yarn 32. By including the single-weave portions 16*b* and 16*c* of the 1/1 structure, it is possible to stabilize the woven structures of the first and second double-weave portions 15*a* and 15*b*.

In the invention, by composing the single-weave portion (binding portion) 16*a* formed between the main tape body 11 and the first double-weave portion 15*a* of the 1/1 structure, it is possible to further stabilize the woven structures of the main tape body 11 and the first double-weave portion 15*a*. As may be necessary, the single-weave portions (binding portions) 16*b* and 16*c* respectively formed between the first double-weave portion 15*a* and the second double-weave portion 15*b*, and between the second double-weave portion 15*b* and the element attaching portion 13 can be composed of 2/2 structures in which warp yarn 31 alternately runs on an upper side of two sets of foundation weft yarn 32 and a lower side of two sets of foundation weft yarn 32.

In the folded tape portion 12 of the embodiment, first warp yarn 31*a* made of low count yarn like the first warp yarn 31*a* arranged in the main tape body 11 is used as the warp yarn 31 which is exposed outside of the fastener stringer 1 when the left and right fastener elements 20 are coupled to each other, that is, the first warp yarn 31*a* is used as warp yarn 31 arranged between the main tape body 11 and the first double-weave portion 15*a*, and as warp yarn 31 on the side of the tape outer surface of the first double-weave portion 15*a* and on the side of the main tape body 11.

Accordingly, asperities caused by differences in thickness of the warp yarn 31 are not formed on the tape outer surface (i.e., outer surface of fastener stringer 1) from the main tape body 11 to a portion where the left and right folded tape portions 12 come into intimate contact with each other, and the tape outer surface can be formed flatly. Hence, the fastener stringer 1 can be finished such that its outward appearance (quality of outward appearance) is excellent.

Second warp yarn 31*b* which is thicker than the first warp yarn 31*a* is used as warp yarn other than the first warp yarn 31*a* in the folded tape portion 12. In this case, the second warp yarn 31*b* is polyester fiber of 500 dtex or more and 2,000 dtex or less, and more preferably, polyester fiber of 1,000 dtex or more and 1,500 dtex or less, 1.0 dtex/f or more and 4.0 dtex/f or less. If the second warp yarn 31*b* having such a thickness is used as the folded tape portion 12, the rigidity of the folded tape portion 12 can further be enhanced.

If the second warp yarn 31*b* which is thicker than the first warp yarn 31*a* is used, even when the rigidity of the folded tape portion 12 is further enhanced, it is possible to secure appropriate bending of the folded tape portion 12 because the folded tape portion 12 is provided with the single-weave portions (binding portions) 16*a*, 16*b* and 16*c* as described above. Hence, it is possible to stably fold the folded tape portion 12 into the U-shape. As a result, a space 19 formed between the folded tape portion 12 and the fastener element 20 can be made small, and a fastener stringer 1 having excellent outward appearance can be obtained.

The element attaching portion 13 in the fastener tape 10 includes a third double-weave portion 15*c* in which an end edge portion on the side of the folded tape portion 12 is formed of a double-weave structure of warp yarn 31. A region from warp yarn 31 arranged in adjacent to the third double-weave portion 15*c* in the element attaching portion 13 to warp yarn 31 arranged in a tape end edge of the fastener tape 10 is composed of a single-weave structure of warp yarn 31.

In this case, the third double-weave portion 15*c* in the element attaching portion 13 is composed of 1/3, 3/1 structure like the first and second double-weave portions 15*a* and 15*b*. The second warp yarn 31*b* is used as warp yarn of the third double-weave portion 15*c* on the side of the tape outer surface and on the side of the folded tape portion 12, and the first warp yarn 31*a* is used as other warp yarn.

By forming the third double-weave portion 15*c* on the element attaching portion 13, as described, it is possible to further enhance rigidity of the folded tape portion 12, especially rigidity of an end edge portion of the folded tape portion 12 on the side of the element attaching portion 13. A range of the element attaching portion 13 where the third double-weave portion 15*c* is formed is not especially limited, and the range where the third double-weave portion 15*c* is formed can freely be changed.

Further, in this embodiment, second warp yarn 31*b* which is thicker than the first warp yarn 31*a* is used as warp yarn arranged in the third double-weave portion 15*c* on the side of the tape outer surface and on the side of the folded tape portion 12. In other words, of warp yarn in the third double-weave portion 15*c*, the second warp yarn 31*b* which is thicker than the first warp yarn 31*a* is more frequently used on the side of the tape outer surface than on the side of the tape inner surface of the third double-weave portion 15*c*. By making the warp yarn 31 arranged on the side of the tape outer surface thick in this manner, it becomes easy to fold the fastener tape toward the tape inner surface.

Hence, even if rigidity of the end portion of the folded tape portion 12 on the side of the element attaching portion 13 is enhanced, it can easily be bent to a predetermined curvature. According to this configuration as well, the space 19 formed between the folded tape portion 12 and the fastener element 20 can be made small and therefore, a fastener stringer having an excellent outward appearance can be obtained.

The first warp yarn 31*a* is used as warp yarn which forms the single-weave structure of the element attaching portion 13. In this case, in the single-weave structure of the element attaching portion 13, the warp yarn 31 which is adjacent to the third double-weave portion 15*c* is arranged in a 1/1 structure in which the warp yarn 31 alternately runs on an upper side of one set of foundation weft yarn 32 and a lower side of one set of foundation weft yarn 32, and other warp yarn 31 is arranged in a 2/2 structure in which the warp yarn 31 runs on an upper side of two sets of foundation weft yarn 32 and a lower side of two sets of foundation weft yarn 32.

By arranging warp yarn 31 which is adjacent to the third double-weave portion 15*c* in the 1/1 structure, it is possible to stabilize the woven structure of the third double-weave portion 15*c*, and to stabilize the woven structure of the single-weave portion formed by the 2/2 structure of the element attaching portion 13. Therefore, when the fastener element 20 is sewed to the element attaching portion 13 by sewing yarn 35, the fastener element 20 can firmly, stably be sewed.

Each of the left and right fastener elements 20 in the embodiment has a continuous coil-shape. Each of the fastener elements 20 includes a coupling head 21, upper and lower legs 22 and 23 extending from the coupling head 21, and a connecting portion 24 which connects the fastener elements 20 which are adjacent to each other. A recessed portion 25 is formed in a lower surface of the lower leg 23 of the fastener element 20, and the sewing yarn 35 through which the fastener element 20 is sewed to the fastener tape 10 can be accommodated in the recessed portion 25.

When the coil-shaped fastener element 20 is attached to the fastener tape 10, the fastener element 20 is sewed to the band-like fastener tape 10 before it is bent to the U-shape using the sewing yarn 35 in a state where a core thread 27 is inserted through an interior of the fastener element 20.

At this time, the coupling head 21 of the fastener element 20 is oriented toward the folded tape portion 12 of the fastener tape 10 and the upper leg 22 is brought into contact with the fastener tape 10 and in this state, the upper and lower legs 22 and 23 and the core thread 27 are sewed to the element attaching portion 13 using the sewing yarn 35 by double chain stitching.

Accordingly, the fastener element 20 is attached to the element attaching portion 13. Thereafter, the fastener tape 10 is folded into the U-shape at the folded tape portion 12, thermo-setting or the like is carried out and the fastener stringer 1 as shown in FIG. 3 is obtained.

According to the fastener stringer 1 of the embodiment, the fastener element 20 is attached to the element attaching portion 13 of the fastener tape 10 by the double chain stitching of the sewing yarn 35. In this case, the sewing yarn 35 includes upper yarn 35*a* which thrusts through the element attaching portion 13 of the fastener tape 10, and a lower yarn 35*b* which runs on the side of the lower leg 23 of the fastener element 20 while confounding with the upper yarn 35*a* between the fastener elements 20.

In this embodiment, yarn of 840 dtex or more and 990 dtex or less is used as the upper yarn 35*a* of the sewing yarn 35, and yarn of 234 dtex or more and 705 dtex or less is used as the lower yarn 35*b*. By using yarn which is thicker than the lower yarn 35*b*, it is possible to sew the fastener element 20 to the element attaching portion 13 while strongly fastening the fastener element 20 by the upper yarn 35*a* without cutting the yarn.

By using the yarn which is thinner than the upper yarn 35*a* as the lower yarn 35*b* of the sewing yarn 35, the lower yarn 35*b* which is exposed to the side of the lower leg 23 of the fastener element 20 can become less noticeable, and the outward appearance of the fastener stringer 1 can be enhanced.

In the fastener stringer 1 of the embodiment, the lower yarn 35*b* of the sewing yarn 35 is accommodated in the recessed portion 25 of the fastener element 20 when the fastener element 20 is sewed. Hence, even if the slider (not shown) is made to slide when the hidden slide fastener 2 is configured, it is possible to prevent the lower yarn 35*b* from interfering with the slider, and to prevent the lower yarn 35*b* from being cut by friction between the lower yarn 35*b* and the slider.

According to the fastener stringer 1 of the embodiment, as shown in FIG. 3, the upper yarn 35*a* of the sewing yarn 35 arranged on the side of the folded tape portion 12 thrusts through a position where the double-weave portion 15 of the element attaching portion 13 is arranged. Accordingly, the sewing yarn 35 is arranged at a position close to the coupling head 21 of the fastener element 20 and the fastener element 20 is sewed. Therefore, a standing position of the folded tape portion 12 (boundary position with respect to the element attaching portion 13) comes close to the coupling head 21. Therefore, when the left and right fastener elements 20 are coupled to each other, it is possible to reliably bring the left and right folded tape portions 12 into intimate contact with each other.

Even if the upper yarn 35*a* of the sewing yarn 35 thrusts through the position where the double-weave portion 15 of the element attaching portion 13 is arranged as described above, the first warp yarn 31*a* which is thinner than the second warp yarn 31*b* is used as a portion of the double-weave portion 15. Hence, when the fastener element 20 is sewed to the element attaching portion 13, for example, a sewing needle can easily be inserted through the double-weave portion 15, the fastener element 20 can smoothly be sewed, and it is possible to prevent the sewing needle from breaking.

According to the fastener stringer 1 of the embodiment, when the left and right fastener elements 20 are coupled to each other, the folded tape portions 12 of the left and right fastener tapes 10 are abutted against each other and brought into intimate contact with each other. Therefore, it is possible to hide the fastener element 20 such that it can not be seen from the outer surface side of the fastener stringer 1.

The folded tape portion 12 of the fastener stringer 1 includes the first and second double-weave portions 15*a* and 15*b*, and the second warp yarn 31*b* which is thicker than the first warp yarn 31*a* is used in the folded tape portion 12. Hence, rigidity of the folded tape portion 12 in the lateral direction of the tape is largely enhanced as compared with a conventional fastener stringer for a hidden slide fastener.

The single-weave portion 16 is formed between both sides of the folded tape portion 12 (i.e., between the main tape body 11 and the first double-weave portion 15*a*, and between the second double-weave portion 15*b* and the element attaching portion 13), and between the first and second double-weave portions 15*a* and 15*b*. Hence, it is possible to effectively prevent a position of the warp yarn 31 arranged in the double-weave portion 15 from being misaligned in the lateral direction of the tape.

Therefore, even if the left and right fastener tapes 10 receive the lateral pulling force in a state where the left and right fastener elements 20 are coupled to each other, it is possible to prevent the left and right folded tape portions 12 from moving in their separating directions. Hence, it is possible to prevent a gap from being formed between the left and right fastener tapes 10 (or to make a gap formed between the left and right fastener tapes 10 small), and the hiding performance of the hidden slide fastener 2 can be enhanced.

Especially according to the fastener stringer 1 of the embodiment, the sewing yarn 35 is arranged at a position close to the coupling head 21 of the fastener element 20, and the fastener element 20 is sewed. Hence, it is possible to effectively prevent a gap from being formed between the left and right fastener tapes 10 also by the sewing yarn 35, and the hiding performance can further be enhanced.

Therefore, even if the hidden slide fastener 2 which is configured using the fastener stringer 1 of the embodiment is used for the seat cover 6 for an automobile as shown in FIG. 1, the fastener stringer 1 can obtain excellent hiding performance, and it is possible to prevent the left and right coupled fastener elements 20 from being seen from outside. Accordingly, it is possible to avoid the conventional problem that since the fastener elements 20 are seen, outward appearance of the automobile seat 5 is deteriorated, or design of the automobile seat 5 is deteriorated.

Further, since the fastener stringer 1 of the embodiment includes the single-weave portion 16 between at least the double-weave portions 15 as described above, it is possible to secure appropriate bending of the folded tape portion 12, and to stably fold the fastener tape 10 into the U-shape. Hence, it is possible to avoid the problem that a posture of the fastener element 20 sewed to the element attaching portion 13 is inclined, and to secure excellent sliding performance of the slider.

The embodiment is one example of a preferred mode of the fastener stringer included in a scope of the invention, but the invention is not limited to the embodiment, and it is possible to employ a woven structure other than the embodiment for the fastener tape only if the folded tape portion of the fastener tape includes at least two multiple-weave portions and the binding portion arranged in at least one location between the multiple-weave portions.

Figure 7:
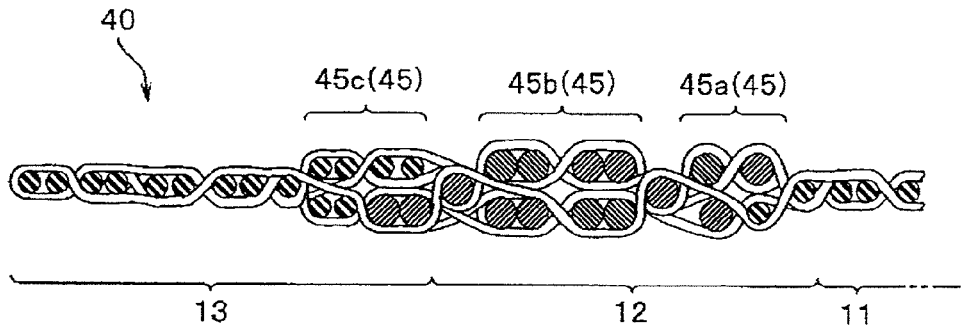
FIG. 7 is a sectional view showing a fastener tape having a different woven structure.

For example, as the fastener tape of the fastener stringer, it is possible to use a woven fastener tape 40 in which the number of warp yarn 31 arranged in second and third double-weave portions 45*b* and 45*c* is increased as shown in FIG. 7. That is, concerning the double-weave portion 45 formed in the fastener tape 40, in each of the second and third double-weave portions 45*b* and 45*c*, two single yarn sets are justified as one set of warp yarn. On the other hand, in a first double-weave portion 45*a*, warp yarn is formed from one single yarn like the above embodiment.

Figure 8:
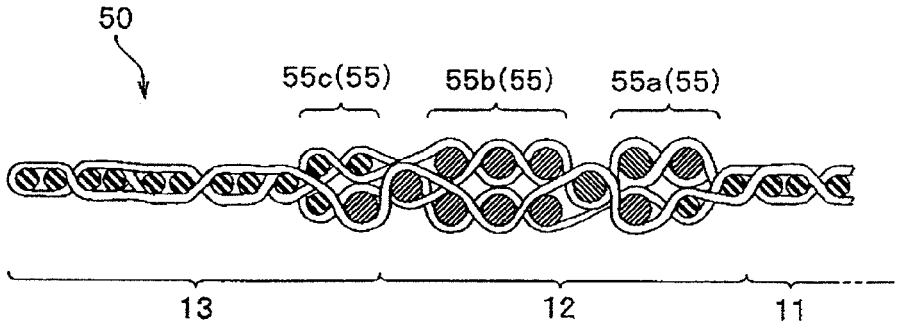
FIG. 8 is a sectional view showing a fastener tape having a different woven structure.

As shown in FIG. 8, concerning a double-weave portion 55 formed on a fastener tape 50, the number of warp yarn 31 arranged in first and third double-weave portions 55*a* and 55*c* is the same, but the number of warp yarn 31 arranged in second double-weave portion 55*b* is increased and a fastener tape 50 can be woven.

Although it is not illustrated in the drawings, double-weave portions can be formed at three or more locations of the folded tape portion of the fastener tape, or a multiple-weave portion having a woven structure in which warp yarn is arranged triply or more can be formed instead of forming double-weave portions in the folded tape portion of the fastener tape and the element attaching portion, and it is also possible to freely change the warp yarn configuring the fastener tape and a thickness of the weft yarn. Even if the fastener stringer is obtained by sewing the fastener element 20 to such a fastener tape, the same effect as that described in the embodiment can be obtained.

According to the fastener stringer 1 of the embodiment, a binding portion which closes (binds) a weave portion on the side of the tape inner surface and a weave portion on the side of the tape outer surface between the first and second double-weave portions 55*a* and 55*b* in the double-weave portions 55*a* and 55*b* is composed of a single-weave portion 16*b* formed from one warp yarn 31 and one foundation weft yarn 32. However, the configuration of the binding portion of the invention is not limited to the above-described single-weave portion 16*b*.

Figure 9:
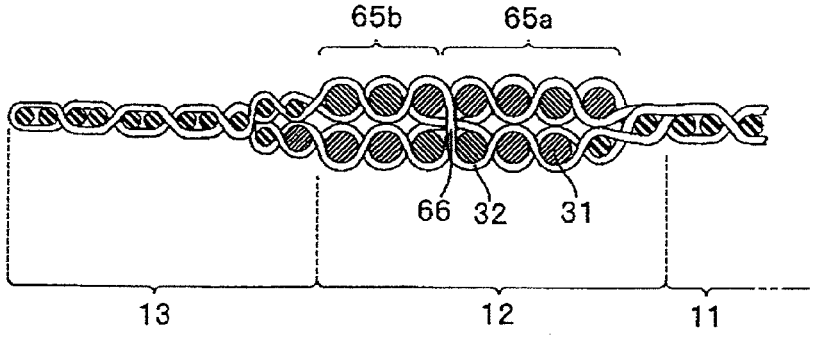
FIG. 9 is a sectional view showing a fastener tape having a different woven structure.

For example, a binding portion which binds two layers of weave portions to each other between the first double-weave portion 55*a* and the second double-weave portion 55*b* can be composed of a single-weave portion formed from two or more warp yarn and two or more foundation weft yarn arranged side-by-side in the lateral direction of the tape. Alternatively, it is also possible to configure a binding portion 66 only from weft yarn 32 which runs to bind a weave portion on the side of the tape inner surface and a weave portion on the side of the tape outer surface to each other between a first double-weave portion 65*a* and a second double-weave portion 65*b* as shown in FIG. 9.

In the fastener stringer 1 of the embodiment, the single-weave portions 16*a* and 16*c* are provided on both ends of each of the folded tape portions 12, but it is not necessary to form the single-weave portions on the both ends of the folded tape portion in the invention. For example, if the bending of the folded tape portion can sufficiently be secured without forming the single-weave portions on both ends of the folded tape portion, the end of the folded tape portion on the side of the main tape body and/or the end of the folded tape portion on the side of the element attaching portion can be composed of two or more multiple-weave portions instead of the single-weave portions.

Figure 10:
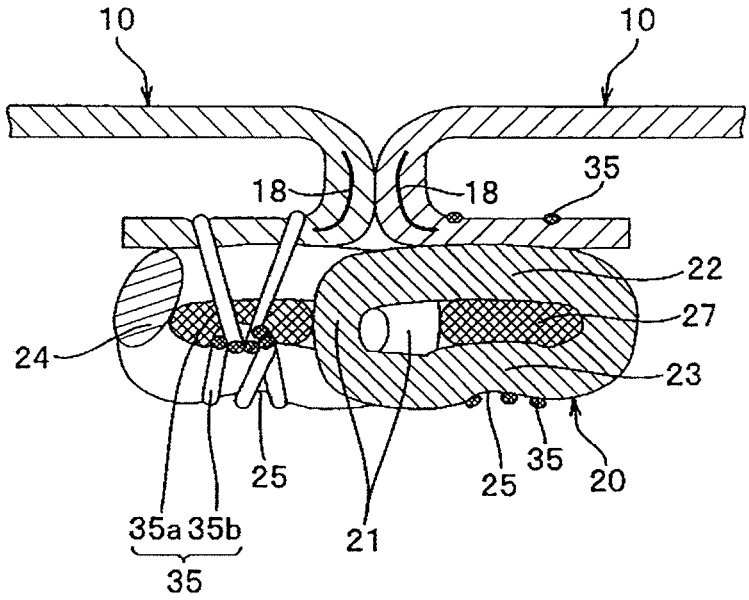
FIG. 10 is a sectional view showing a fastener stringer for a hidden slide fastener according to a modification of the invention.
Figure 11:
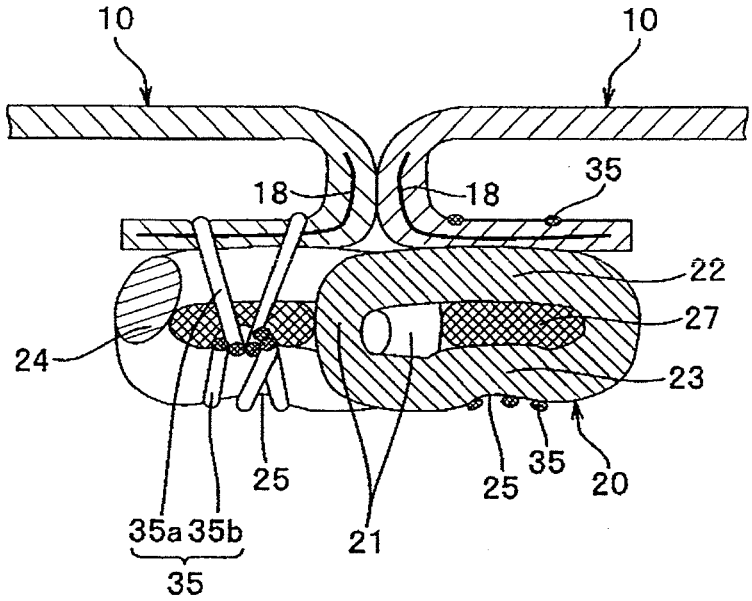
FIG. 11 is a sectional view showing a fastener stringer for a hidden slide fastener according to another modification of the invention.

Further, in the fastener stringer 1 of the embodiment, regions (double-weave regions 18) where the double-weave portions 15 of the fastener tapes 10 are formed are formed in the entire folded tape portions 12 and portions of the element attaching portions 13 as shown in FIG. 2. However, the invention is not limited to this, it is also possible to form the double-weave region 18 only in the folded tape portion 12 as shown in FIG. 10, or to form the double-weave regions 18 in the entire folded tape portion 12 and the element attaching portion 13 as shown in FIG. 11.

DESCRIPTION OF REFERENCE NUMERALS

1 fastener stringer
2 hidden slide fastener
5 automobile seat
6 seat cover
6*a* skin material
7 sewing yarn
10 fastener tape
11 main tape body
12 folded tape portion
13 element attaching portion
15 double-weave portion
15*a* first double-weave portion
15*b* second double-weave portion
15*c* third double-weave portion
16, 16*a* single-weave portion (binding portion)
16*b*, 16*c* single-weave portion (binding portion)
18 double-weave region
19 space
20 fastener element
21 coupling head
22 upper leg
23 lower leg
24 connecting portion
25 recessed portion
27 core thread
31 warp yarn
31*a* first warp yarn
31*b* second warp yarn
32 foundation weft yarn
35 sewing yarn
35*a* upper yarn
35*b* lower yarn
40 fastener tape
45 double-weave portion
45*a* first double-weave portion
45*b* second double-weave portion
45*c* third double-weave portion
50 fastener tape
55 double-weave portion
55*a* first double-weave portion
55*b* second double-weave portion
55*c* third double-weave portion
65*a* first double-weave portion
65*b* second double-weave portion
66 binding portion

The invention claimed is:

1. A fastener stringer for a hidden slide fastener, comprising:

a pair of left and right woven fastener tapes having a front tape surface and a back tape surface, and continuous fastener elements attached to the left and right fastener tapes, in which each of the left and right fastener tapes includes a main tape body, a folded tape portion which extends from one side edge of the main tape body in a lateral direction of a tape and which is folded into a U-shape, and an element attaching portion which further extends from the folded tape portion and to which the fastener element is attached, the fastener element includes a coupling head, upper and lower legs extending from the coupling head, and a connecting portion which connects between the fastener elements which are adjacent to each other, wherein the folded tape portion includes at least two multiple-weave portions comprising a multiple-weave structure in which two or more layers of weave portions formed of warp yarn and weft yarn are laminated on each other from the front tape surface to the back tape surface, and a single-weave portion arranged in at least one location of an intermediate portion of the folded tape portion in which warp yarn and weft yarn forms a single-weave structure.

2. A fastener stringer for a hidden slide fastener comprising:

a pair of left and right woven fastener tapes having the front tape surface and the back tape surface, and continuous fastener elements attached to the left and right fastener tapes, in which each of the left and right fastener tapes includes a main tape body, a folded tape portion which extends from one side edge of the main tape body in a lateral direction of a tape and which is folded into a U-shape, and an element attaching portion which further extends from the folded tape portion and to which the fastener element is attached, the fastener element includes a coupling head, upper and lower legs extending from the coupling head, and a connecting portion which connects between the fastener elements which are adjacent to each other, wherein the folded tape portion includes at least two multiple-weave portions in which two or more layers of weave portions formed of warp yarn and weft yarn are laminated on each other from the front tape surface to the back tape surface, and a binding portion which closes at least the two layers of weave portions of the multiple-weave portions in at least one location between the two multiple-weave portions.

3. The fastener stringer for a hidden slide fastener according to claim 1, wherein the single-weave portion is arranged in at least one end of the folded tape portion.

4. The fastener stringer for a hidden slide fastener according to claim 2, wherein the bonding portion is arranged in at least one end of the folded tape portion.

5. The fastener stringer for a hidden slide fastener according to claim 1, wherein first warp yarn is used as the warp yarn arranged in the main tape body, and second warp yarn which is thicker than the first warp yarn is used as at least a portion of the warp yarn arranged in the folded tape portion.

6. The fastener stringer for a hidden slide fastener according to claim 2, wherein first warp yarn is used as the warp yarn arranged in the main tape body and second warp yarn which is thicker than the first warp yarn is used as at least a portion of the warp yarn arranged in the folded tape portion.

7. The fastener stringer for a hidden slide fastener according to claim 5, wherein the first warp yarn is used as the warp yarn which is arranged in the folded tape portion and which is exposed outside when the left and right fastener elements are coupled to each other.

8. The fastener stringer for a hidden slide fastener according to claim 6, wherein the first warp yarn is used as the warp yarn which is arranged in the folded tape portion and which is exposed outside when the left and right fastener elements are coupled to each other.

9. The fastener stringer for a hidden slide fastener according to claim 5, wherein the element attaching portion includes the multiple-weave portions at an end edge of the folded tape portion.

10. The fastener stringer for a hidden slide fastener according to claim 6, wherein the element attaching portion includes the multiple-weave portions at an end edge of the folded tape portion.

11. The fastener stringer for a hidden slide fastener according to claim 9, wherein the fastener element is sewed using sewing yarn, and the first warp yarn is used as at least one of warp yarn arranged in the multiple-weave portions of the element attaching portion.

12. The fastener stringer for a hidden slide fastener according to claim 10, wherein the fastener element is sewed using sewing yarn, and the first warp yarn is used as at least one of warp yarn arranged in the multiple-weave portions of the element attaching portion.

13. The fastener stringer for a hidden slide fastener according to claim 11, wherein of warp yarn arranged in the multiple-weave portions of the element attaching portion, the first warp yarn is used as warp yarn for a portion through which the sewing yarn thrusts, and the second warp yarn is used as the warp yarn of other portions.

14. The fastener stringer for a hidden slide fastener according to claim 12, wherein of warp yarn arranged in the multiple-weave portions of the element attaching portion, the first warp yarn is used as warp yarn for a portion through which the sewing yarn thrusts, and the second warp yarn is used as the warp yarn of other portions.

15. The fastener stringer for a hidden slide fastener according to claim 5, wherein yarn of 150 dtex or more and 450 dtex or less, 4.5 dtex/f or more and 10.0 dtex/f or less is used as the first warp yarn.

16. The fastener stringer for a hidden slide fastener according to claim 6, wherein yarn of 150 dtex or more and 450 dtex or less, 4.5 dtex/f or more and 10.0 dtex/f or less is used as the first warp yarn.

17. The fastener stringer for a hidden slide fastener according to claim 5, wherein yarn of 500 dtex or more and 2,000 dtex or less, 1.0 dtex/f or more and 4.0 dtex/f or less is used as the second warp yarn.

18. The fastener stringer for a hidden slide fastener according to claim 6, wherein yarn of 500 dtex or more and 2,000 dtex or less, 1.0 dtex/f or more and 4.0 dtex/f or less is used as the second warp yarn.

19. The fastener stringer for a hidden slide fastener according to claim 1, wherein the multiple-weave portions is composed of a double-weave portion of a 1/3, 3/1 structure.

20. The fastener stringer for a hidden slide fastener according to claim 2, wherein the multiple-weave portions is composed of a double-weave portion of a 1/3, 3/1 structure.

21. The fastener stringer for a hidden slide fastener according to claim 1, wherein the single-weave portion arranged in the intermediate portion of the folded tape portion is formed of a 1/1 structure.

22. The fastener stringer for a hidden slide fastener according to claim 1, wherein a region of the element attaching portion from the warp yarn arranged in the end edge of the tape to the warp yarn which is adjacent to the multiple-weave portions is formed of a single-weave structure, and the warp yarn which is adjacent to the multiple-weave portions has a 1/1 structure.

23. The fastener stringer for a hidden slide fastener according to claim 1, wherein the fastener element is sewed to the fastener tapes by double chain stitching of the sewing yarn, and yarn of 840 dtex or more and 990 dtex or less is used as the upper yarn of the sewing yarn which thrusts through the fastener tapes, and yarn of 234 dtex or more and 705 dtex or less is used as the lower yarn which passes through the fastener element on a side of the lower leg.

24. The fastener stringer for a hidden slide fastener according to claim 2, wherein the fastener element is sewed to the fastener tapes by double chain stitching of the sewing yarn, and yarn of 840 dtex or more and 990 dtex or less is used as the upper yarn of the sewing yarn which thrusts through the fastener tapes, and yarn of 234 dtex or more and 705 dtex or less is used as the lower yarn which passes through the fastener element on a side of the lower leg.

25. The fastener stringer for a hidden slide fastener according to claim 1, wherein the multiple-weave portions are arranged in a portion that is in intimate contact with the other one of the pair of fastener tapes.

26. The fastener stringer for a hidden slide fastener according to claim 2, wherein the multiple-weave portions are arranged in a portion that is in intimate contact with the other one of the fastener tapes.

* * * * *

UNITED STATES PATENT AND TRADEMARK OFFICE

CERTIFICATE OF CORRECTION

PATENT NO. : 8,739,372 B2
APPLICATION NO. : 13/393247
DATED : June 3, 2014
INVENTOR(S) : Takayuki Hasegawa et al.

It is certified that error appears in the above-identified patent and that said Letters Patent is hereby corrected as shown below:

In the Specification

In column 8, line 43, delete “the a” and insert -- the --, therefor.

Signed and Sealed this
Seventh Day of October, 2014

Michelle K. Lee

Michelle K. Lee
*Deputy Director of the United States Patent and Trademark Office*